US006935128B2

(12) United States Patent
Ito et al.

(10) Patent No.: US 6,935,128 B2
(45) Date of Patent: Aug. 30, 2005

(54) VAPOR-COMPRESSION-TYPE REFRIGERATING MACHINE

(75) Inventors: Shigeki Ito, Okazaki (JP); Teruyuki Hotta, Nagoya (JP); Yasushi Yamanaka, Nakashima-gun (JP)

(73) Assignee: DENSO Corporation, Kariya (JP)

( * ) Notice: Subject to any disclaimer, the term of this patent is extended or adjusted under 35 U.S.C. 154(b) by 7 days.

(21) Appl. No.: 10/794,710

(22) Filed: Mar. 5, 2004

(65) Prior Publication Data

US 2004/0172958 A1 Sep. 9, 2004

(30) Foreign Application Priority Data

Mar. 5, 2003 (JP) ..... 2003-058507

(51) Int. Cl.[7] ..... F25B 41/04; F25B 41/00
(52) U.S. Cl. ..... 62/222; 62/513; 236/92 B
(58) Field of Search ..... 62/113, 222, 224, 62/225, 513; 236/92 B

(56) References Cited

U.S. PATENT DOCUMENTS 6,334,324 B1 * 1/2002 Muta et al. ..... 62/222
2004/0112073 A1 * 6/2004 Ito et al. ..... 62/196.4

FOREIGN PATENT DOCUMENTS

JP 2002-213842 7/2002

* cited by examiner

*Primary Examiner*—Marc Norman
(74) *Attorney, Agent, or Firm*—Harness, Dickey & Pierce, PLC

(57) ABSTRACT

The internal heat exchanger 7 is provided which exchanges heat between the refrigerant of low pressure and the refrigerant of high pressure, and the pre-load adjusting mechanism of the expansion valve 5 is abolished. Due to the above structure, the refrigerant flowing into the expansion valve 5 is cooled in the internal heat exchanger 7, and enthalpy of the refrigerant flowing into the evaporator 6 is reduced. On the contrary, the refrigerant sucked into the compressor 1 is heated. Accordingly, a difference in enthalpy between the refrigerant at the inlet and the refrigerant at the outlet of the evaporator 6 can be made large, and the heat absorbing capacity of the evaporator 6 can be enhanced, and further it becomes possible to give the degree of superheat to the refrigerant sucked into the compressor 1. Therefore, even if the pre-load adjusting mechanism is abolished, the vapor-compression-type refrigerating machine can be stably operated.

12 Claims, 11 Drawing Sheets

RELATION BETWEEN STATE OF REFRIGERANT AT OUTLET OF EVAPORATOR AND AIR CONDITIONING PERFORMANCE

VAPOR-COMPRESSION-TYPE REFRIGERATING MACHINE

BACKGROUND OF THE INVENTION

1. Field of the Invention

The present invention relates to a vapor-compression-type refrigerating machine for moving heat from a portion on the low temperature side to a portion on the high temperature side. The vapor-compression-type refrigerating machine of the present invention is effectively applied to an air conditioner for vehicle use.

2. Description of the Related Art

As well known, the vapor-compression-type refrigerating machine operates as follows. A liquid phase refrigerant is decompressed by an expansion valve, and the refrigerant, the pressure of which has been reduced, is evaporated so as to absorb heat, and the thus evaporated refrigerant, the phase of which has become a gas phase, is adiabatically compressed by a compressor so that the temperature can be raised and the heat absorbed in the process of evaporation can be radiated.

It is conventional that the expansion valve is provided with a spring for giving a pre-load (initial load) to the valve body which adjusts the degree of throttle opening so that the degree of superheat of the refrigerant sucked into the compressor can be in a predetermined range. Concerning this technique, for example, refer to the official gazette of Japanese Unexamined Patent Publication No. 2002-213842.

In this connection, the expansion valve is composed of a plurality of parts such as a diaphragm, valve body and so forth. Usually, the maximum displacement of the valve body is not more than 1 mm, that is, the maximum displacement of the valve body is very small. Accordingly, even if the dimensional fluctuation of parts composing the expansion valve is small, operation of the valve body can be greatly affected.

Therefore, it is conventional to provide a pre-load adjusting mechanism for adjusting a pre-load (initial load) given to the valve body or diaphragm by a spring. When the pre-load adjusting mechanism is adjusted after all parts have been assembled, the pre-load is adjusted so that the valve body can be appropriately operated.

According to the expansion valve described in the official gazette of Japanese Unexamined Patent Publication No. 2002-213842, the pre-load adjusting mechanism is provided. It is necessary to adjust the pre-load adjusting mechanism after all parts have been assembled. Therefore, it is difficult to decrease the number of parts of the expansion valve. Further, it is difficult to reduce the number of processes in the manufacturing process.

SUMMARY OF THE INVENTION

The present invention was accomplished in view of the above points. It is a first object of the present invention to provide a vapor-compression-type refrigerating machine including a new expansion valve different from the conventional one. It is a second object of the present invention to reduce the manufacturing cost of the vapor-compression-type refrigerating machine by reducing the manufacturing cost of the expansion valve.

In order to accomplish the above objects, according to an aspect of the present invention, a vapor-compression-type refrigerating machine for moving heat from a low temperature side to a high temperature side, comprises: a compressor (1) for sucking and compressing refrigerant; a radiator (2) for radiating heat from the refrigerant of high pressure; an expansion valve (5) for decompressing and expanding the refrigerant cooled by the radiator (2); an evaporator (6) for evaporating the refrigerant decompressed by the expansion valve (5) so that heat can be absorbed by the refrigerant; and an internal heat exchanger (7) for exchanging heat between the refrigerant of high pressure before the decompression by the expansion valve (5) and the refrigerant of low pressure to be sucked by the compressor (1), the expansion valve (5) including: a thin film-like diaphragm (5*c*) forming an airtightly closed space (5*a*) into which a predetermined mass of gas is enclosed; a valve body (5*d*) for changing a degree of throttle opening being interlocked with a displacement of the diaphragm (5*c*); a spring (5*q*) for giving an elastic force to the valve body (5*d*) in a direction so that a volume of the airtightly closed space (5*a*) can be reduced, from an opposite side of the diaphragm (5*c*) to the side of the diaphragm (5*c*) on which the airtightly closed space (5*a*) is located; and a load giving portion (5*r*) for giving an initial load to the spring (5*q*), wherein pressure in the airtightly closed space (5*a*) changes according to the temperature of the refrigerant flowing out from the evaporator (6), pressure of the refrigerant flowing out from the evaporator (6) acts on an opposite side of the diaphragm (5*c*) to the side of the diaphragm (5*c*) on which the airtightly closed space (5*a*) is located, and the load giving portion (5*r*) can not be moved with respect to the housing (5*j*).

According to the present invention, the internal heat exchanger (7) is provided. Therefore, the refrigerant flowing into the expansion valve (5) is cooled by this internal heat exchanger (7), and the enthalpy of the refrigerant flowing into the evaporator (6) is reduced. On the contrary, the refrigerant sucked into the compressor (1) is heated by this internal heat exchanger (7). Accordingly, a difference of enthalpy between the refrigerant at the inlet and the refrigerant at the outlet of the evaporator (6) is increased, and the heat absorbing capacity of the evaporator (6) can be enhanced. Further, as the degree of superheat of the refrigerant sucked into the compressor (1) can be enhanced, even if the pre-load adjusting mechanism is abolished, the vapor compression type refrigerating machine can be stably operated.

Accordingly, as the manufacturing cost of the expansion valve (5) can be reduced, the manufacturing cost of the vapor compression type refrigerating machine can be decreased.

According to another aspect of the present invention, a vapor-compression-type refrigerating machine for moving heat from a portion on the low temperature side to a portion on the high temperature side, comprises: a compressor (1) for sucking and compressing refrigerant; a radiator (2) for radiating heat from the refrigerant of high pressure; an expansion valve (5) for decompressing and expanding the refrigerant cooled by the radiator (2); an evaporator (6) for evaporating the refrigerant decompressed by the expansion valve (5) so that heat can be absorbed by the refrigerant; and an internal heat exchanger (7) for exchanging heat between the refrigerant of high pressure before the decompression by the expansion valve (5) and the refrigerant of low pressure to be sucked by the compressor (1), the expansion valve (5) including: a thin film-like diaphragm (5*c*) forming an airtightly closed space (5*a*) into which a predetermined mass of gas is enclosed; and a valve body (5*d*) for changing a degree of throttle opening being interlocked with a displacement of the diaphragm (5*c*), wherein pressure in the airtightly closed space (5*a*) changes according to the temperature of the refrigerant flowing out from the evaporator (6), pressure of the refrigerant flowing out from the evaporator (6) acts on an opposite side of the diaphragm (5*c*) to the side of the diaphragm (5*c*) on which the airtightly closed space (5*a*) is located, and the diaphragm (5*c*) is displaced only by a difference in pressure between the airtightly closed space (5*a*) and the refrigerant flowing out from the evaporator (6).

As the internal heat exchanger (7) is provided in the present invention, the refrigerant flowing into the expansion valve (5) is cooled by this internal heat exchanger (7). Therefore, enthalpy of the refrigerant flowing into the evaporator (6) is reduced. On the contrary, the refrigerant sucked into the compressor (1) is heated.

Accordingly, a difference of enthalpy between the refrigerant at the inlet and the refrigerant at the outlet of the evaporator (6) is increased, and the heat absorbing property of the evaporator (6) can be enhanced. Further, as the degree of superheat of the refrigerant sucked into the compressor (1) can be enhanced, even if the pre-load adjusting mechanism is abolished, the vapor compression type refrigerating machine can be stably operated.

Accordingly, as the manufacturing cost of the expansion valve (5) is reduced, the manufacturing cost of the vapor-compression-type refrigerating machine can be decreased.

According to the present invention, the connecting rod (5*f*) for connecting the diaphragm (5*c*) with the valve body (5*d*) is joined to the diaphragm (5*c*), and further the connecting rod (5*f*) is joined to the valve body (5*d*).

Due to the above structure, the diaphragm (5*c*) and the valve body (5*d*) can be integrally displaced. Therefore, the expansion valve (5) can respond quickly.

In the present invention, the diaphragm case (5*s*) for supporting the diaphragm (5*c*) from an opposite side of the diaphragm (5*c*) to the side of the diaphragm (5*c*), on which the airtightly closed space (5*a*) is located, is formed being integrated with the housing (5*j*) in which the valve seat (5*h*) is formed. Alternatively, the diaphragm case (5*s*) is integrally joined to the housing (5*j*).

Due to the above structure, the dimensional accuracy of assembling the diaphragm (5*c*), valve body (5*d*) and valve seat (5*h*) can be enhanced.

According to the present invention, the internal heat exchanger (7) is a double tube composed of an inner cylindrical tube (7*a*) and outer cylindrical tube (7*b*).

According to the present invention, the expansion valve (5) is accommodated in the piping means which composes a refrigerant passage in which the refrigerant of low pressure is flowing.

Due to the above structure, for example, while the expansion valve (5) is being protected from heat generated by the running engine, noise generated by the vibration of the expansion valve (5) can be reduced. Further, while a malfunction of the expansion valve (5) caused by heat generated by the engine is being prevented, the degree of freedom can be extended when a position, at which the expansion valve (5) is mounted, is to be determined.

According to the present invention, the expansion valve (5) is fixed in such a manner that the expansion valve (5) can be elastically displaced in the piping means (8).

Due to the above structure, vibration of the expansion valve (5) generated in the process of decompression can be absorbed. Therefore, noise caused by the vibration of the expansion valve (5) can be reduced.

According to the present invention, the internal heat exchanger (7) and the expansion valve (5) are integrated with each other into one body.

Due to the above structure, the number of pipes can be reduced. Therefore, the number of processes for assembling the vapor compression type refrigerating machine can be decreased, and the vapor-compression-type refrigerating machine can be installed in a small space.

The present invention may be more fully understood from the description of preferred embodiments of the invention, as set forth below, together with the accompanying drawings.

DESCRIPTION OF THE PREFERRED EMBODIMENTS (First Embodiment)

Figure 1:
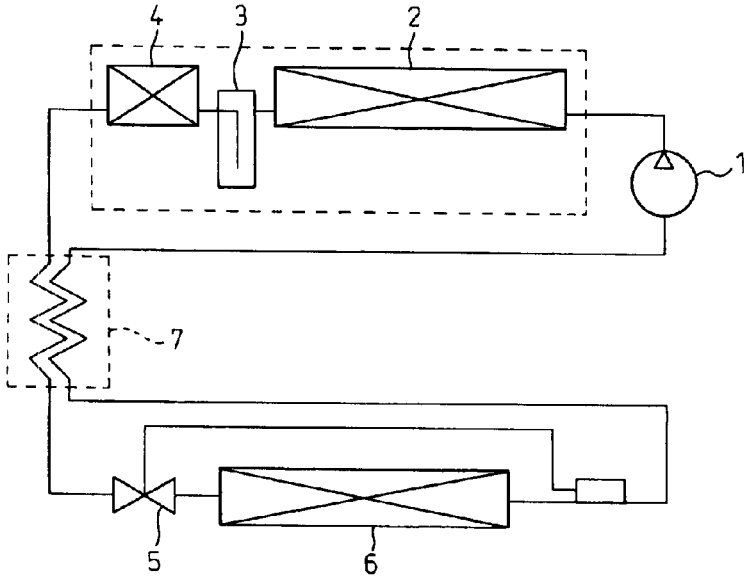
FIG. 1 is a view showing a model of a vapor-compression-type refrigerating machine of a first embodiment of the present invention.
Figure 2:
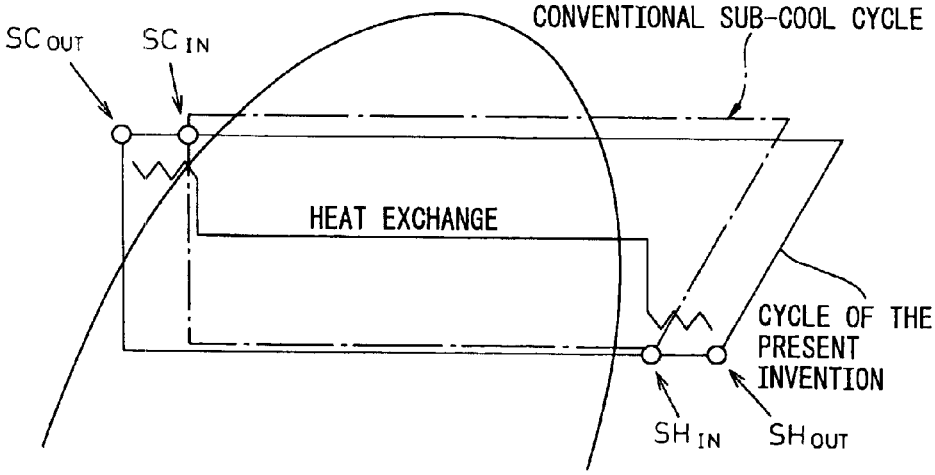
FIG. 2 is a p-h diagram of the vapor-compression-type refrigerating machine of the first embodiment of the present invention.
Figure 3:
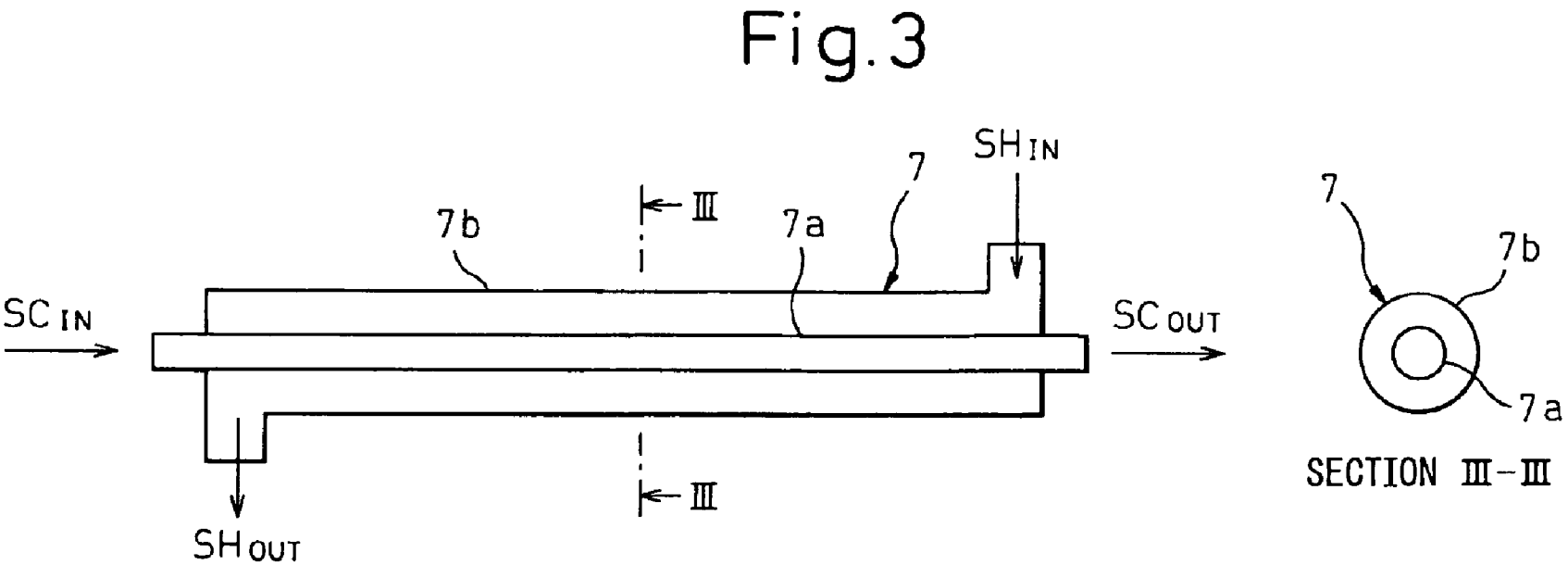
FIG. 3 is a schematic illustration of the internal heat exchanger of the first embodiment of the present invention.

In this embodiment, the vapor-compression-type refrigerating machine of the present invention is applied to an air-conditioner for vehicle use. FIG. 1 is a view showing a model of the vapor-compression-type refrigerating machine of the present invention, and FIG. 2 is a p–h diagram of the vapor compression type refrigerating machine of the present invention.

In FIG. 1, the compressor 1 sucks and compresses the refrigerant. In this embodiment, the compressor 1 is assembled to an engine for running and driven by the power supplied from the engine. The radiator 2 is a heat exchanger on the high pressure side which exchanges heat between the refrigerant of high pressure, which has been discharged from the compressor 1, and the outside air so that the refrigerant of high pressure can be cooled.

In this connection, in this embodiment, the pressure of the refrigerant of high pressure is set at a value lower than the critical pressure of the refrigerant. Therefore, while the refrigerant is changing from the vapor phase to the liquid phase in the radiator 2, the enthalpy of the refrigerant is decreased.

The receiver 3 is a vapor-liquid separator for separating the refrigerant flowing out from the radiator 2 into a vapor-phase refrigerant and a liquid-phase refrigerant and for storing the redundant refrigerant as the liquid-phase refrigerant. The supercooler 4 is a sub-cooler for further cooling the liquid phase refrigerant, which is supplied from the receiver 3, so as to enhance the degree of supercooling of the refrigerant.

In this connection, in the present embodiment, the radiator 2 which functions as a condenser, receiver 3 and supercooler 4, are integrated with each other into one body by means of brazing.

The expansion valve 5 is a decompressing means for decompressing the refrigerant at high pressure. In this embodiment, the temperature type expansion valve is employed in which the variable throttling portion for adjusting the degree of throttling according to the degree of superheat on the delivery side of the evaporator 6 and the temperature detecting portion for detecting the degree of superheat of the refrigerant are integrated into one body. The detailed explanations of the structure will be made later.

The evaporator 6 is a low temperature side heat exchanger for evaporating the liquid phase refrigerant which has been decompressed by the expansion valve 5. In this embodiment, the evaporator 6 operates in such a manner that heat is absorbed from a current of air blowing out into the passenger's compartment and the refrigerant is evaporated so that the current of air blowing out into the passenger's compartment can be cooled and the thus absorbed heat is radiated outside by the radiator 2. On the contrary, heat may be absorbed from the outside air and the thus absorbed heat may be radiated into the current of air blowing out into the passenger's compartment so that the passenger's compartment can be heated.

In the internal heat exchanger 7, heat is exchanged between the refrigerant at high pressure, before the decompression conducted by the expansion valve 5, and the refrigerant of low pressure, to be sucked into the compressor 1. By this internal heat exchanger 7, the refrigerant flowing into the expansion valve 5 is cooled, and the enthalpy of the refrigerant flowing into the evaporator 6 is decreased. On the contrary, the refrigerant sucked into the compressor 1 is heated, and the degree of superheat can be increased.

In this connection, the internal heat exchanger 7 is a double tube type heat exchanger composed of an inner cylindrical tube 7*a*, in which the refrigerant of high pressure flows, and an outer cylindrical tube 7*b* in which the refrigerant of low pressure flows. In this connection, in this embodiment, both the inner cylindrical tube 7*a* and the outer cylindrical tube 7*b* are formed into a cylinder. However, it should be noted that the present invention is not limited to the above specific embodiment and, for example, both the inner cylindrical tube 7*a* and the outer cylindrical tube 7*b* may be formed into a square tube.

Next, referring to FIGS. 4 and 5, the structure of the expansion valve 5 will be described below.

Figure 4:
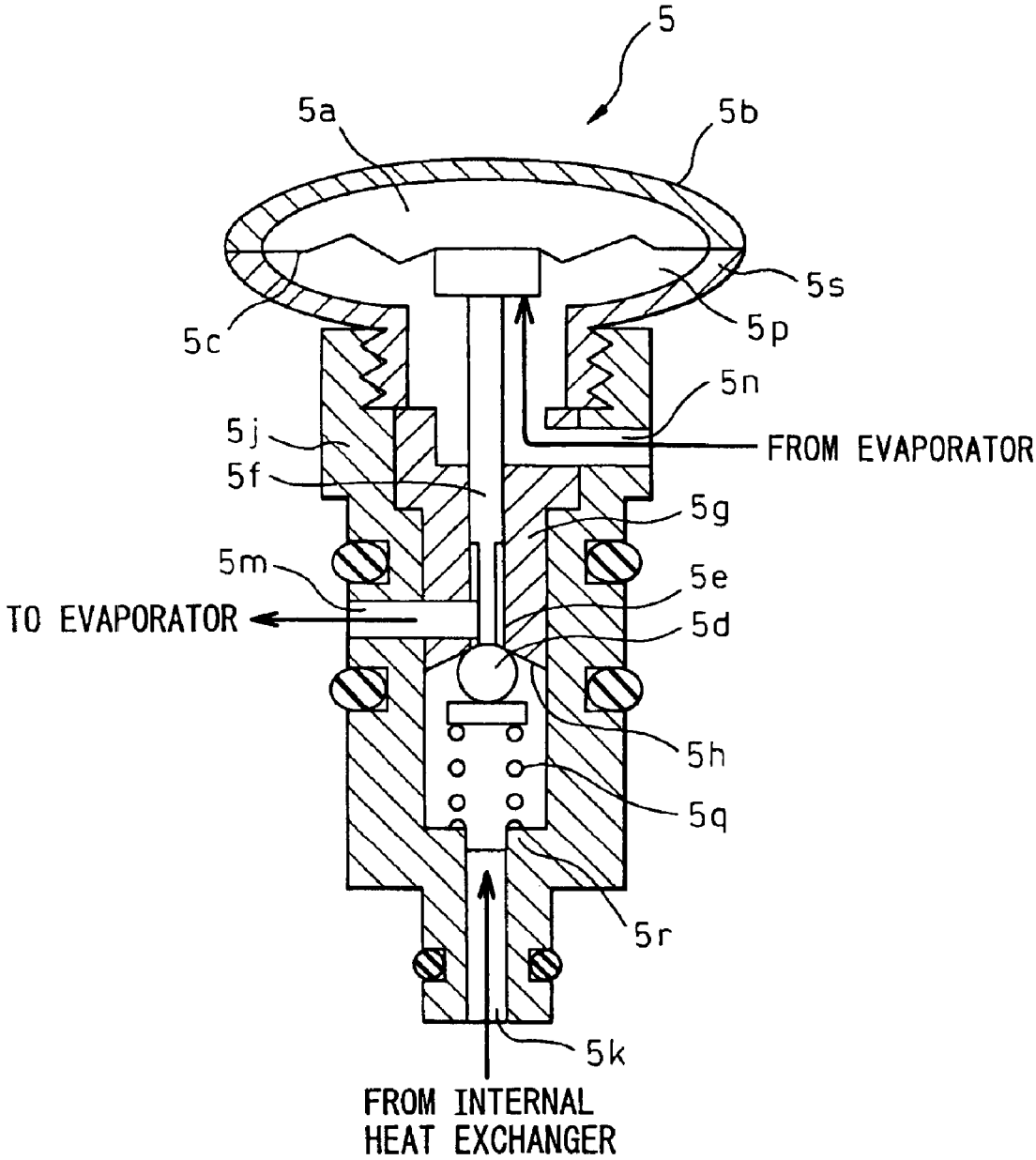
FIG. 4 is a schematic illustration of the expansion valve of the first embodiment of the present invention.

In FIG. 4, the first pressure chamber 5*a* is an airtightly closed space in which a predetermined mass of gas (refrigerant gas in this embodiment) is enclosed. This first pressure chamber 5*a* is composed of a first diaphragm case 5*b* made of rigid material such as metal and a thin film-like diaphragm 5*c*.

The valve body 5*d* adjusts the degree of throttle opening of the expansion valve 5, that is, the degree of opening of the valve port 5*e*. The valve body 5*d* and the diaphragm 5*c* are mechanically interlocked with each other and displaced together via the pillar-shaped connecting rod 5*f*.

The spacer 5*g* guides a displacement of the connecting rod 5*f* so that the connecting rod 5*f* can be reciprocated in the axial direction. In this spacer 5*g*, the conical tapered valve seat 5*h*, to stabilize the valve body 5*d*, is formed. This spacer 5*g* is inserted into the housing 5*j* by transition fit or interference fit.

The housing 5*j* includes: a high pressure refrigerant inlet 5*k* connected to the internal heat exchanger 7; a decompressed refrigerant outlet 5*m* connected to the refrigerant inlet side of the evaporator 6; and a low pressure refrigerant introducing port 5*n* for introducing the pressure of the refrigerant which has flowed out from the evaporator 6.

The pressure introduced from the low pressure refrigerant introducing port 5*n* is introduced into the second pressure chamber 5*p* provided on the opposite side of the diaphragm 5*c* to the side of the diaphragm 5*c* on which the first pressure chamber 5*a* is located. Therefore, the pressure introduced from the low pressure refrigerant introducing port 5*n* acts on the diaphragm 5*c* from the opposite side to the first pressure chamber 5*a*.

In this connection, the second pressure chamber 5*p* is composed of the diaphragm 5*c*, housing 5*j* and second diaphragm case 5*s*. The second diaphragm case 5*s* is screwed to the housing 5*j*.

Accordingly, the gas pressure in the first pressure chamber 5*a* acts on the diaphragm 5*c* in a direction so that the throttle opening can be increased. On the other hand, the refrigerant pressure in the second pressure chamber 5*p* acts on the diaphragm 5*c* in a direction so that the throttle opening can be decreased.

In this connection, as the temperature in the second pressure chamber 5*p* is substantially the same as the refrigerant temperature on the refrigerant outlet side of the evaporator 6, the temperature in the second pressure chamber 5*p* is transmitted into the first pressure chamber 5*a* via the diaphragm 5*c* and the connecting rod 5*f*. Therefore, the temperature in the first pressure chamber 5*a* becomes substantially the same as the refrigerant temperature on the refrigerant outlet side of the evaporator 6. At this time, as a predetermined mass of refrigerant is enclosed into the first pressure chamber 5*a* and the vapor-phase refrigerant in the first pressure chamber 5*a* is kept in the saturated state at all times, the inner pressure of the first pressure chamber 5*a* is the same as the pressure of saturated gas.

The spring 5*q* is an elastic means for giving an elastic force to the diaphragm 5*c* via the valve body 5*d* and the connecting rod 5*f*, wherein this elastic force acts so that a volume of the first pressure chamber 5*a* can be reduced from the side of the diaphragm 5*c* opposite to the side of the diaphragm 5*c* on which the first pressure chamber 5*a* is located, that is, from the second pressure chamber 5*p* side to the first pressure chamber 5*a* side. The initial load given to this spring 5*q* is determined by a distance from the load giving portion 5*r* having a step portion, which comes into contact with the spring 5*q* on the opposite side to the valve body 5*d*, to the valve seat 5*h*.

In this case, according to this present embodiment, as the load giving portion 5*r* is formed being integrated with the housing 5*j* into one body, the load giving portion 5*r* can not be moved with respect to the housing 5*j*, that is, the load giving portion 5*r* and the housing 5*j* are composed into a fixed structure. That is, according to this present embodiment, the pre-load adjusting mechanism for adjusting the initial load is abolished, and the initial load is set at a fixed value by the dimensional relation between the load giving portion 5*r* and the valve seat 5*h*.

In this connection, the maximum displacement of the valve body 5*d* at the time of operation of the vapor-compression-type refrigerating machine is small and, further, the spring constant of the spring 5*q* is set at a low value. Therefore, the load, which the spring 5*q* gives to the diaphragm 5*c*, is substantially the same as the initial load irrespective of the position of the valve body 5*d*. Therefore, the diaphragm 5*c* is displaced so that the force, which is generated by the gas pressure in the first pressure chamber 5*a*, can be balanced with the sum of the force, which is generated by the pressure in the second pressure chamber 5*p*, and the initial load.

Figure 5:
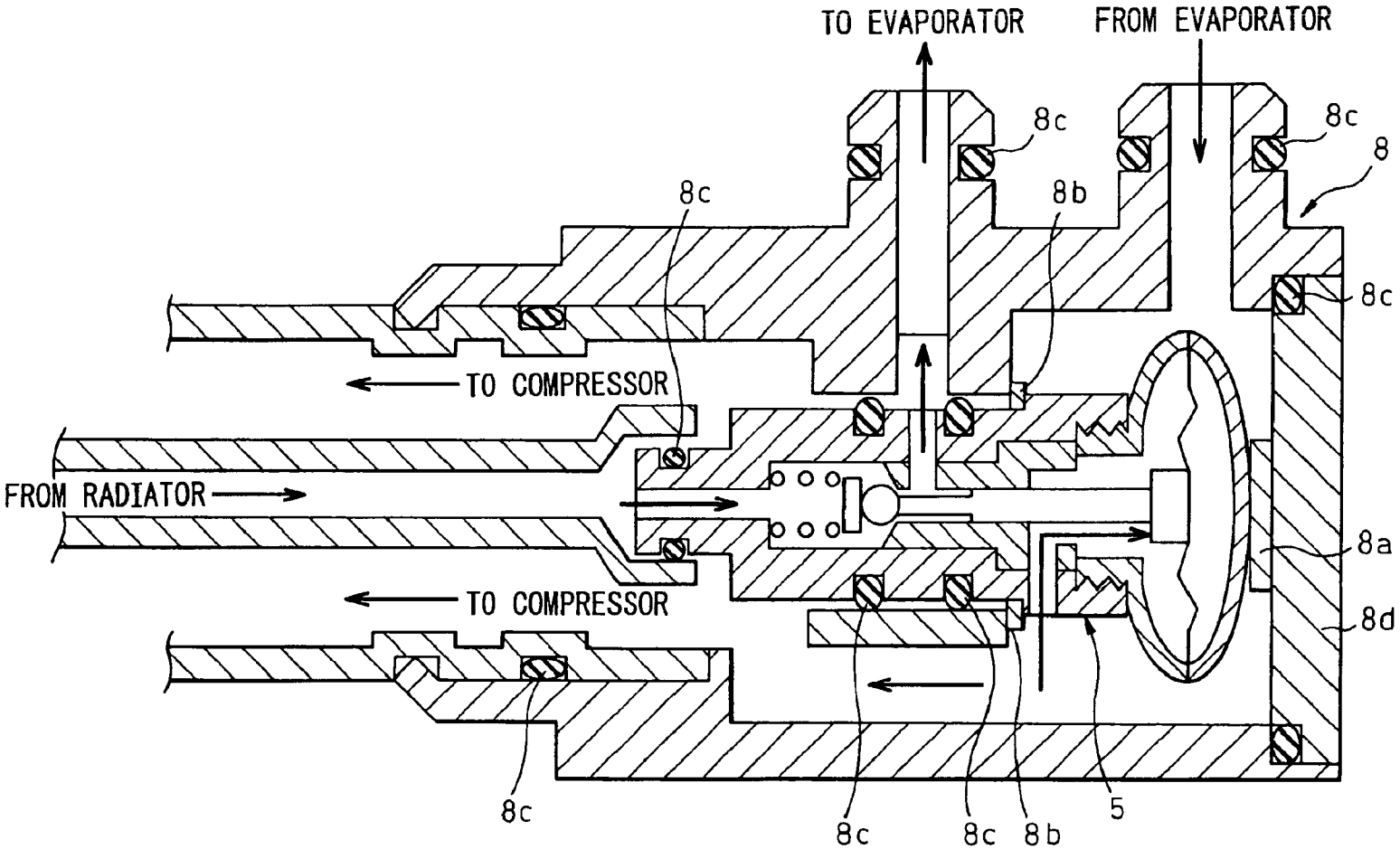
FIG. 5 is a schematic illustration of the expansion valve of the first embodiment of the present invention.

As shown in FIG. 5, the expansion valve 5 is integrated with the internal heat exchanger 7 into one body under the condition that the piping means for making the refrigerant of low pressure flow by connecting the internal heat exchanger 7 with the compressor 1 and the piping means for connecting the expansion valve 5 with the evaporator 6 are accommodated in the integrated casing 8.

In this case, as the expansion valve 5 is fixed in the casing 8 being interposed between the elastic members 8*a* and 8*b* made of rubber capable of being elastically deformed, the expansion valve 5 can be elastically deformed in the piping means 7.

In this connection, O-ring 8*c* is a packing member for maintaining the airtightness of the joining portion, and the lid 8*d* is a member for closing the opening through which the expansion valve 5 is inserted into the casing 8. In this embodiment, parts of the expansion valve 5, the casing 8 and the internal heat exchanger 7 are made of metal, and the casing 8 and the internal heat exchanger 7 are combined with each other by means of calking, and the lid 8*d* is fixed to the casing 8 by screws.

Next, the operation and effect of this embodiment will be described below.

A quantity of latent heat of evaporation is much larger than a quantity of sensible heat (specific heat of refrigerant in the vapor phase). Therefore, in order to effectively increase the refrigerating capacity of the vapor-compression-type refrigerating machine, that is, in order to effectively increase the quantity of heat absorbed by the evaporator 6, it is necessary to evaporate the refrigerant in the liquid phase in all regions from the refrigerant inlet to the refrigerant outlet of the evaporator 6.

When the refrigerant of the liquid phase, the quantity of which is larger than the quantity of the refrigerant corresponding to the heat to be absorbed by the evaporator 6, is supplied to the evaporator 6, the refrigerant of the liquid phase can be evaporated in all regions from the refrigerant inlet to the refrigerant outlet of the evaporator 6. Accordingly, the quantity of heat to be absorbed by the evaporator 6 can be positively ensured. However, there is a high possibility that the refrigerant of the liquid phase is sucked into the compressor 1. When the refrigerant in the liquid phase is sucked into the compressor 1, the refrigerant is excessively compressed, and the discharging pressure of the compressor 1 is abnormally raised, which causes damage in the compressor 1 and the radiator 2.

However, the pressure of gas in the first pressure chamber 5*a* is the saturated gas pressure, and the diaphragm 5*c* is displaced so that the force, which is generated by the gas pressure in the first pressure chamber 5*a*, can be balanced with the sum of the force, which is generated by the pressure in the second pressure chamber 5*p*, and the initial load. Therefore, the degree of throttle opening of the expansion valve 5 is controlled so that the degree of superheat of the refrigerant at the inlet 5*n* for introducing the refrigerant of low pressure can be a value corresponding to the initial load. Accordingly, from the ideal viewpoint, there is no possibility that the refrigerant of the liquid phase is sucked into the compressor 1.

Accordingly, as described in the Related Art section, an operation is conventionally conducted as follows. In order to absorb a difference between the individual bodies of the expansion valves 5, which is caused by the dimensional fluctuation, after all parts have been assembled, the pre-load adjusting mechanism is adjusted, so that the initial load can be adjusted and the valve body 5*d* can be appropriately operated.

On the other hand, in this embodiment, as the internal heat exchanger 7 is provided, the refrigerant flowing into the expansion valve 5 is cooled by this internal heat exchanger 7, and enthalpy of the refrigerant flowing into the evaporator 6 is decreased. Therefore, the refrigerant sucked into the compressor 1 is heated, on the contrary.

Accordingly, the heat absorbing capacity of the evaporator 6 can be enhanced by making a difference in enthalpy between the refrigerant inlet and the refrigerant outlet of the evaporator 6 large, and it becomes possible to give a degree of superheat to the refrigerant sucked into the compressor 1. Accordingly, even if the pre-load adjusting mechanism is abolished, the vapor compression type refrigerating machine can be stably operated.

Figure 6:
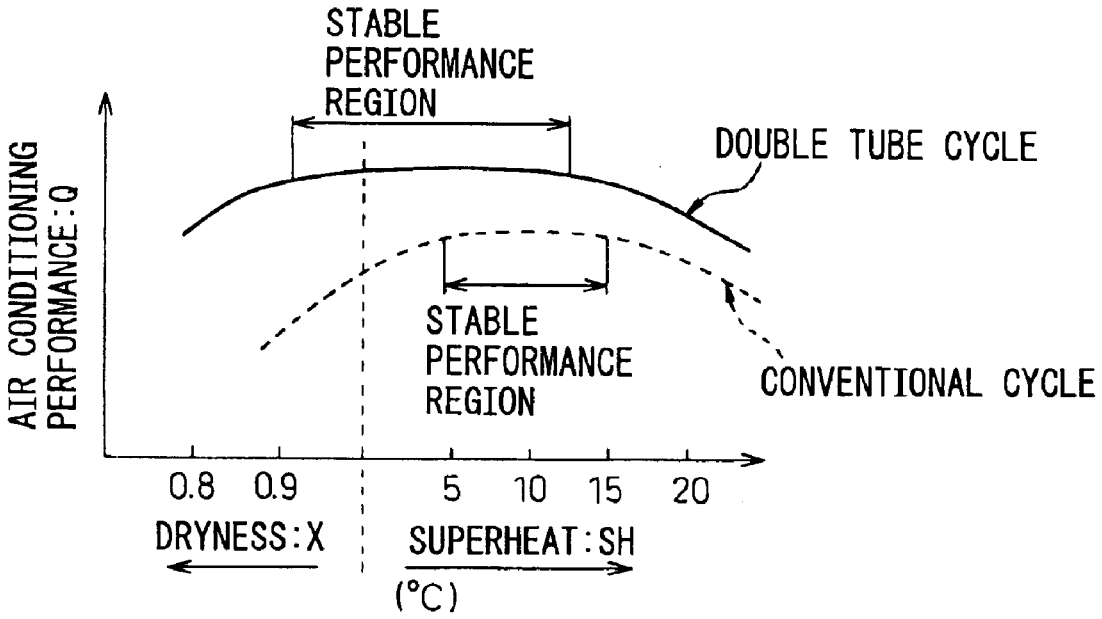
FIG. 6 is a graph showing a relation between the refrigerating capacity and the degree of superheat.

As shown in FIG. 6, it is conventional that the pre-load adjusting mechanism is adjusted so that the degree of superheat can be in a predetermined range at the refrigerant outlet of the evaporator 6. However, according to the present invention, as the vapor-compression-type refrigerating machine is provided with the internal heat exchanger 7, for example, even if the refrigerant of the liquid phase exists at the refrigerant outlet of the evaporator 6, it is possible to give the degree of superheat to the refrigerant which is sucked into the compressor 1. Therefore, the vapor-compression-type refrigerating machine can be stably operated in a wide operational range.

As the expansion valve 5 is accommodated in the casing 8 which composes a piping means, noise caused by the vibration of the expansion valve 5 can be reduced while the expansion valve 5 is being protected from heat transmitted from the engine for running. Accordingly, while the occurrence of malfunction of the expansion valve 5 caused by the heat transmitted from the engine is being previously prevented, the degree of freedom of arranging the expansion valve 5 can be extended.

As the internal heat exchanger 7 and the expansion valve 5 are integrated with each other into one body, it is possible to reduce the number of pipes and further it is possible to reduce the number of processes for assembling the vapor-compression-type refrigerating machine to a vehicle. Furthermore, it is possible to mount the vapor-compression-type refrigerating machine in a small space.

As the expansion valve 5 is fixed in the casing 8 in such a manner that the expansion valve 5 can be elastically displaced, the vibration of the expansion valve 5 generated in the process of decompression can be absorbed. Therefore, the occurrence of noise caused by the vibration of the expansion valve 5 can be reduced.

(Second Embodiment)

Figure 7:
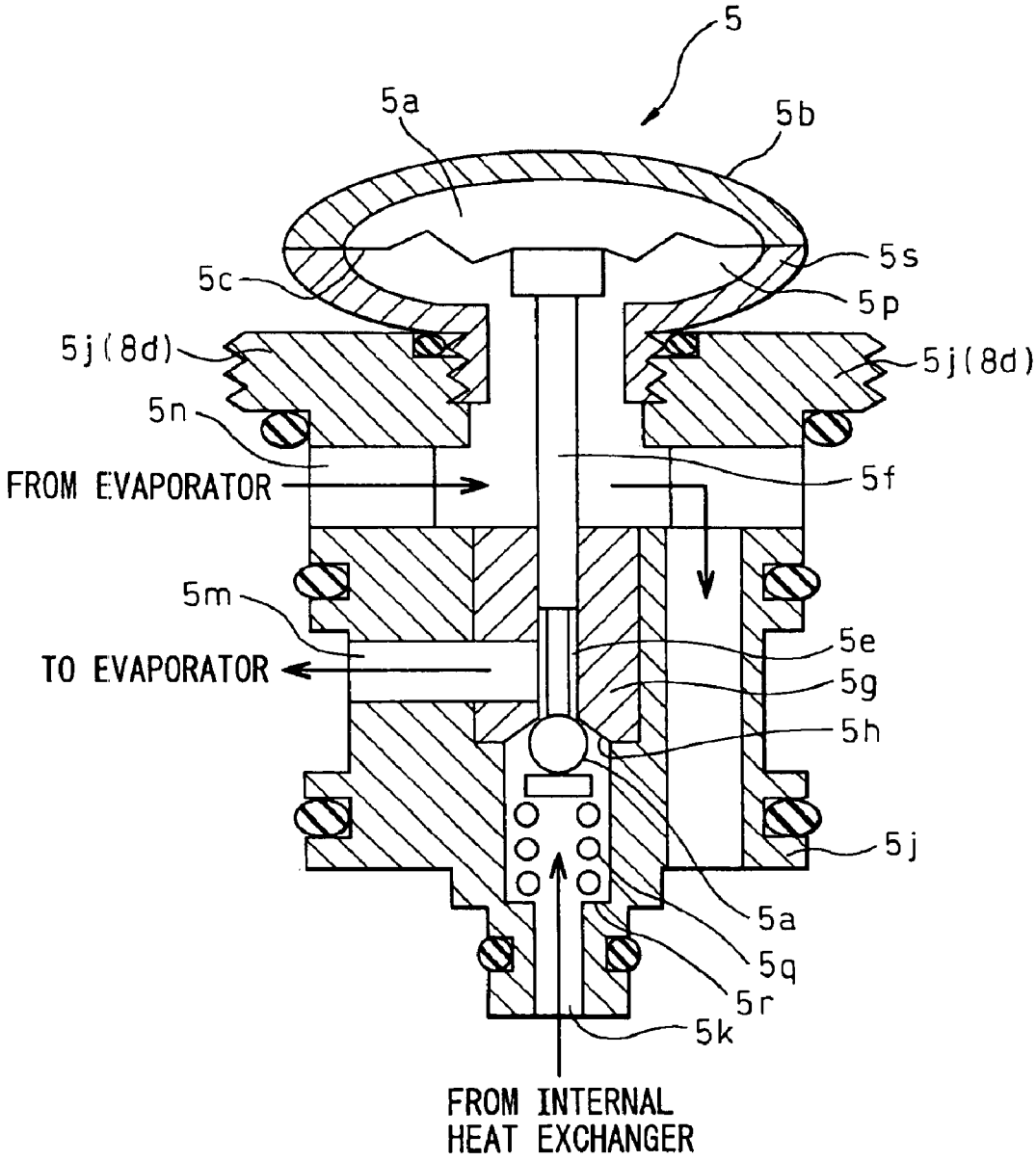
FIG. 7 is a schematic illustration of an expansion valve of a second embodiment of the present invention.
Figure 8:
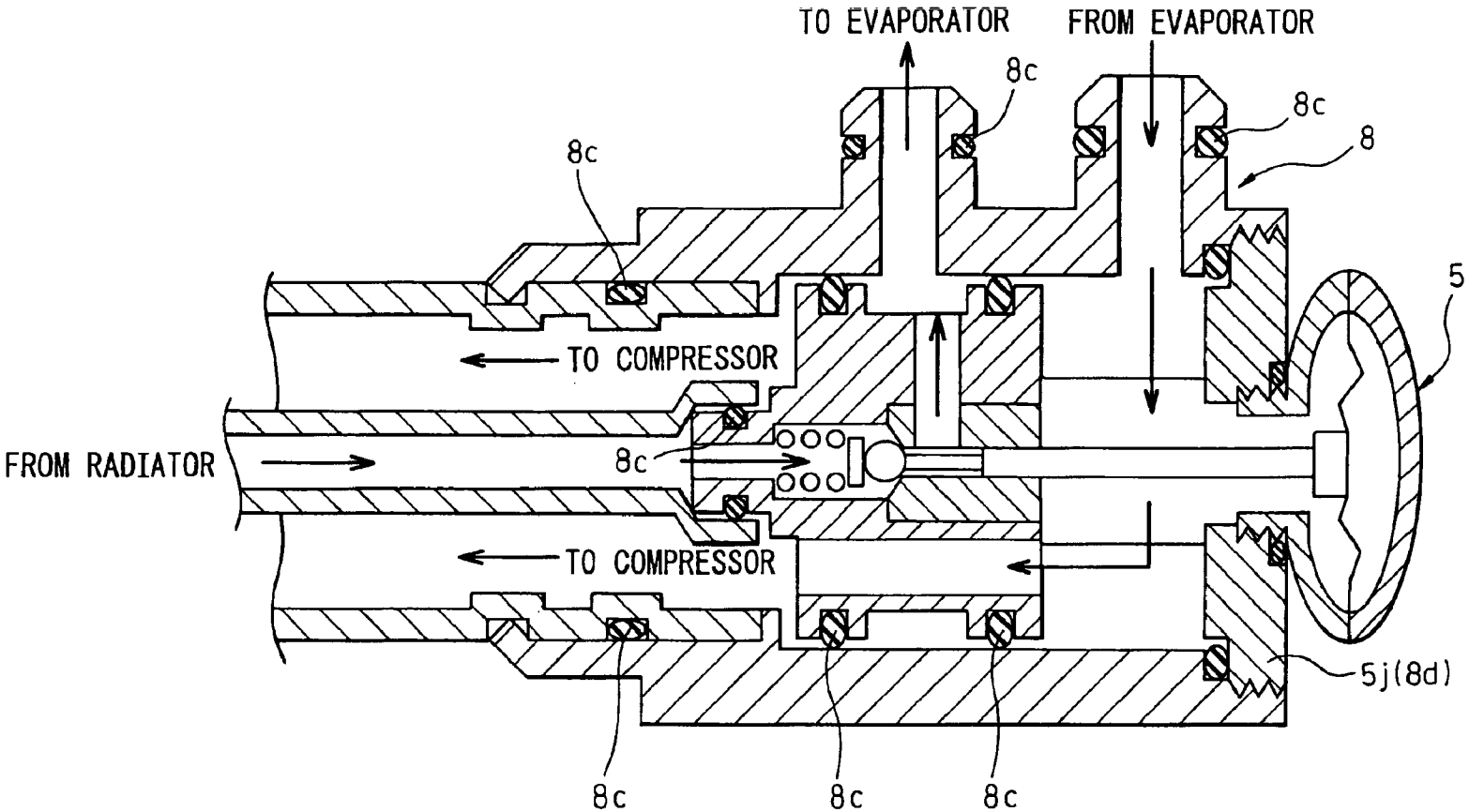
FIG. 8 is a schematic illustration of the expansion valve of the second embodiment of the present invention.

In the first embodiment, the entire expansion valve 5 is accommodated in the casing 8. However, according to the second embodiment, as shown in FIGS. 7 and 8, when the lid 8*d* is arranged in the expansion valve 5, the lid 8*d* of the casing 8 is abolished, so that the number of processes for assembling can be reduced and further the number of parts can be reduced.

In this connection, in this embodiment, under the condition that the valve port 5*e* of the expansion valve 5, that is, the throttling portion is accommodated in the casing 8, the expansion valve 5 is fixed in the casing 8 capable of being elastically displaced. Therefore, vibration of the expansion valve 5 generated in the process of decompression can be absorbed, and the occurrence of noise caused by the vibration of the expansion valve 5 can be reduced.

(Third Embodiment)

Figure 9:
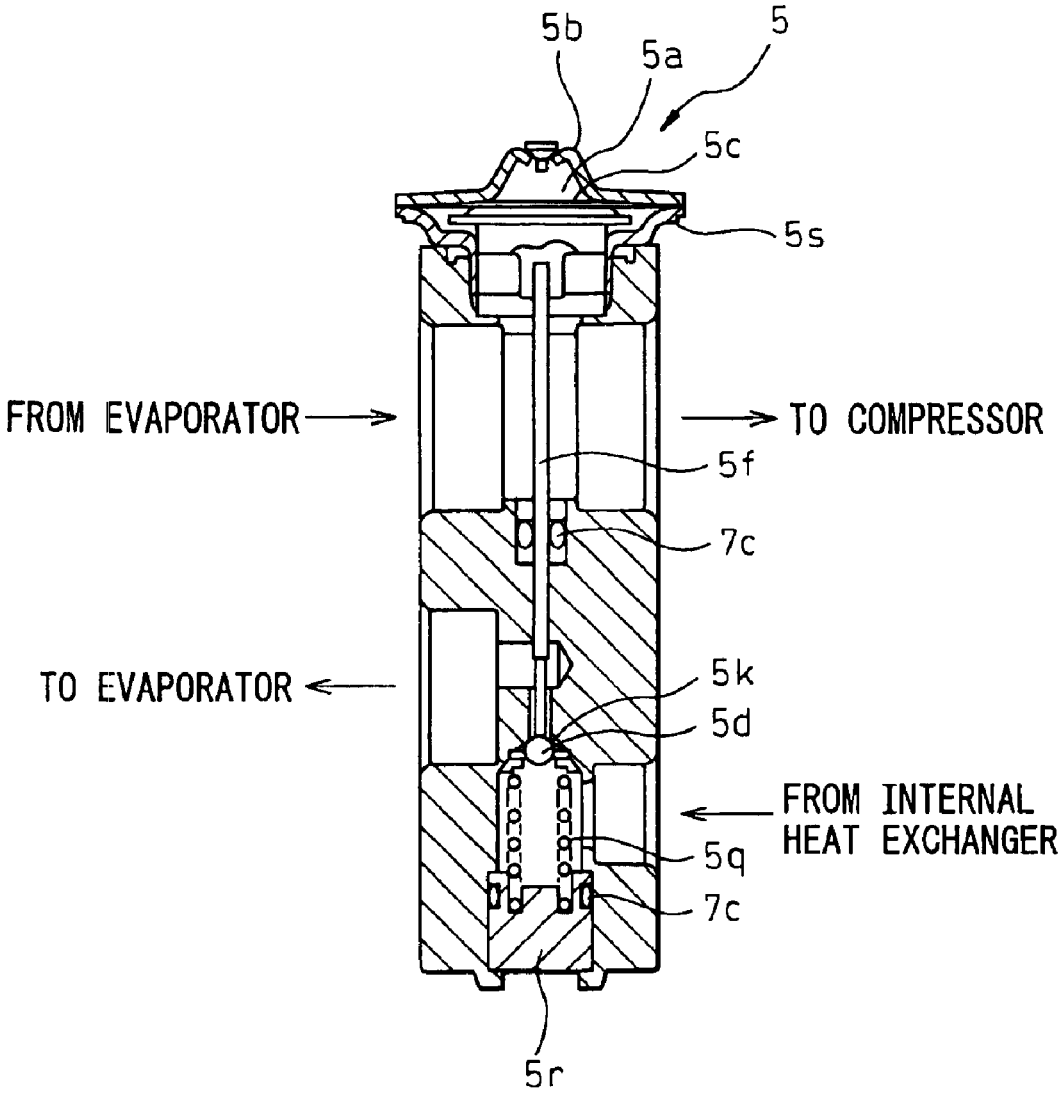
FIG. 9 is a schematic illustration of an expansion valve of a third embodiment of the present invention.

In the first and the second embodiment, the expansion valve 5 is accommodated in the casing 8. However, according to the this embodiment, as shown in FIG. 9, the expansion valve 5 is composed of a single body.

In this connection, in the first and the second embodiment, the load giving portion 5*r* is formed being integrated with the housing 5*j* into one body. However, in this embodiment, the load giving portion 5*r* is formed being separate from the housing 5*j*, and the load giving portion 5*r* is fixed to the housing 5*j* by means of calking so that the load giving portion 5*r* can not be moved with respect to the housing 5*j*.

In this connection, in the first and the second embodiment, in the case where the control characteristic of the expansion valve 5 is changed in the first and the second embodiment, it is necessary that at least one of the spacer 5*g* and the housing 5*j* is changed so as to change a dimensional relation between the load giving portion 5*r* and the valve seat 5*h*. However, according to this embodiment, when the thickness of the load giving portion 5*r* is changed, the dimensional relation between the load giving portion 5*r* and the valve seat 5*h* can be changed. Therefore, parts except for the load giving portion 5*r* can be used in common.

(Fourth Embodiment)

Figure 10:
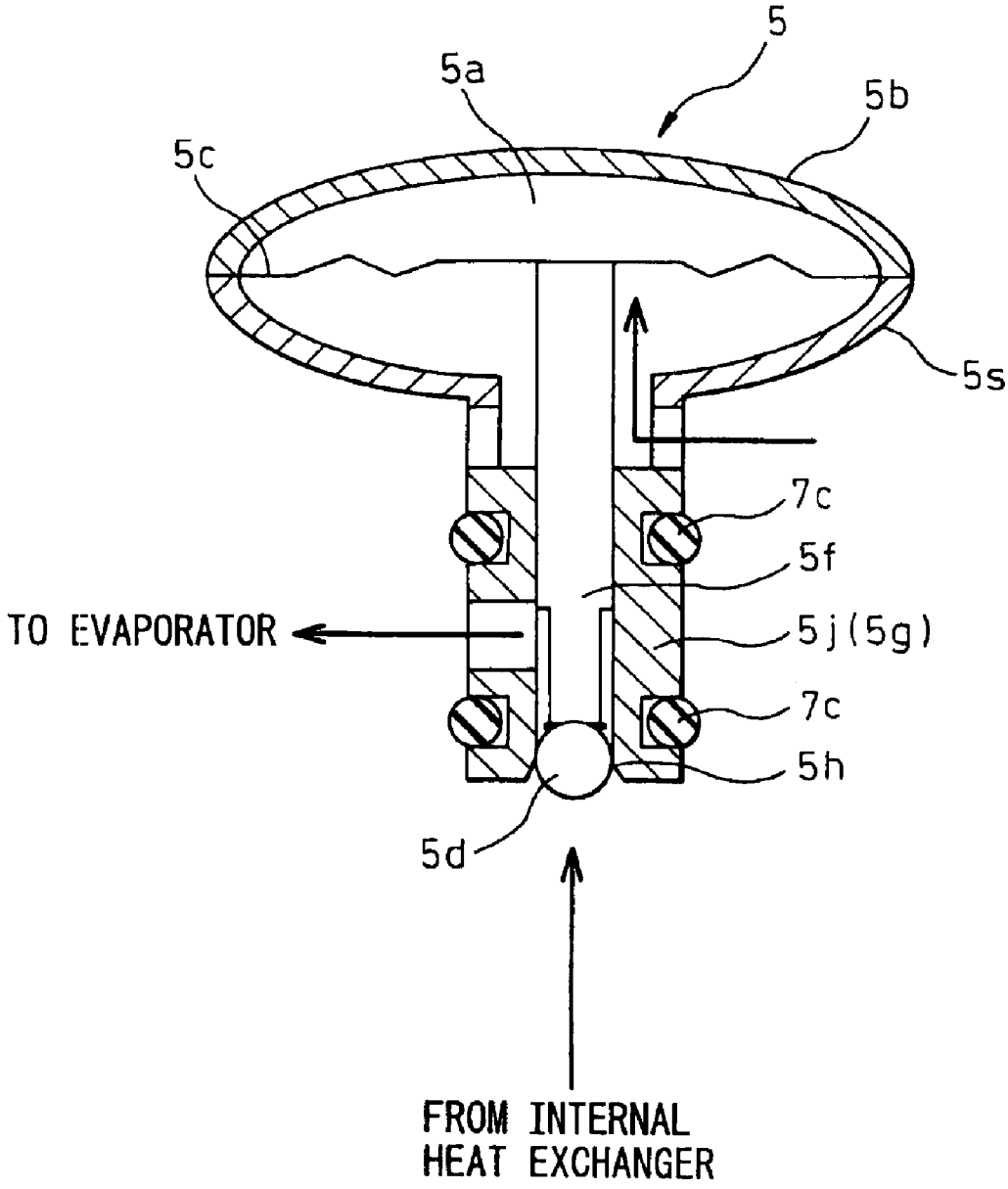
FIG. 10 is a schematic illustration of an expansion valve of a fourth embodiment of the present invention.
Figure 11:
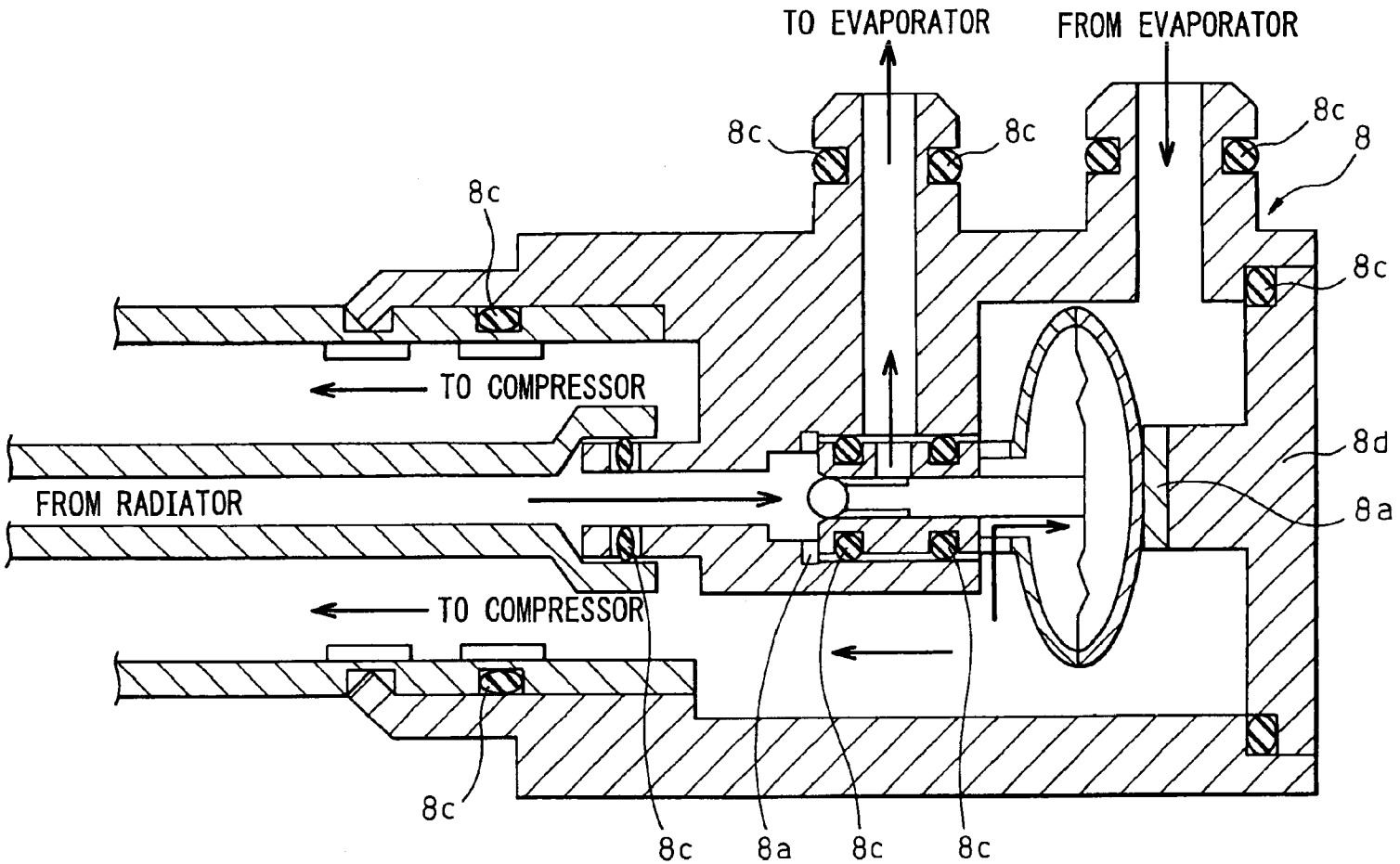
FIG. 11 is a schematic illustration of an expansion valve of a fourth embodiment of the present invention.

In the first to the third embodiment, the expansion valve 5 includes a spring 5*q* to give the initial load. However, according to this embodiment, as shown in FIGS. 10 and 11, the spring 5*q* is abolished, and the diaphragm 5*c* is displaced only by the pressure difference Δp between the pressure of gas in the first pressure chamber 5*a* and the pressure in the second pressure chamber 5*p*.

In this connection, in the present embodiment, the diaphragm 5*c* and the connecting rod 5*f* are connected with each other by means of welding or soldering, and the connecting rod 5*f* and the valve body 5*d* are connected with each other by means of welding or soldering. Further, the second diaphragm case 5*s* is integrated with the housing 5*j* into one body.

In this connection, in the present embodiment, after the connecting rod 5*f* and the valve body 5*d* have been joined to each other, the connecting rod 5*f* is inserted into the housing 5*j*, and the diaphragm 5*c* and the connecting rod 5*f* are joined to each other.

Next, the operation and effect of this embodiment will be described below.

Figure 12:
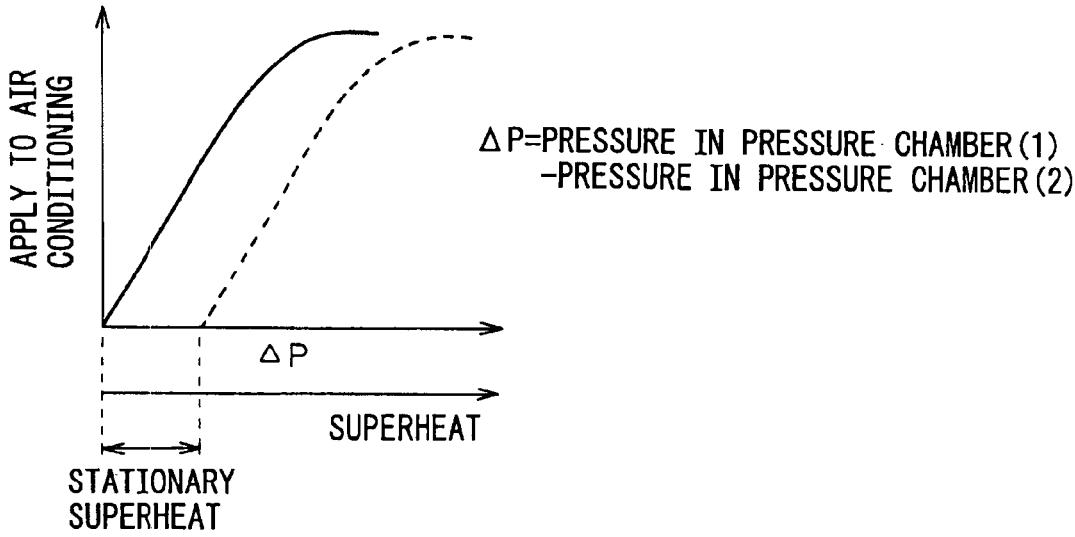
FIG. 12 is a graph showing a relation between the flow rate and the degree of superheat.

As the pressure of gas in the first pressure chamber 5*a* is the saturated gas pressure and the diaphragm 5*c* is displaced so that the force, which is generated by the gas pressure in the first pressure chamber 5*a*, can be balanced with the force which is generated by the pressure in the second pressure chamber 5*p*, the degree of throttle opening of the expansion valve 5 is controlled so that the pressure of the refrigerant at the introducing port 5*n* of introducing the refrigerant of low pressure can be the saturated gas pressure as shown by the solid line in FIG. 12, that is, the degree of throttle opening of the expansion valve 5 is controlled so that the degree of superheat can be 0 in the state in which the compressor 1 is stopped.

On the other hand, in this embodiment, as the internal heat exchanger 7 is provided, the refrigerant flowing into the expansion valve 5 is cooled by this internal heat exchanger 7, and enthalpy of the refrigerant flowing into the evaporator 6 is decreased. Therefore, the refrigerant sucked into the compressor 1 is heated, on the contrary.

Accordingly, the heat absorbing capacity of the evaporator 6 can be enhanced by making a difference in enthalpy between the refrigerant inlet and the refrigerant outlet of the evaporator 6 large, and it becomes possible to give the degree of superheat to the refrigerant sucked into the compressor 1. Accordingly, even if the pre-load adjusting mechanism is abolished, the vapor-compression-type refrigerating machine can be stably operated.

As the diaphragm 5*c* and the connecting rod 5*f* are joined to each other and the connecting rod 5*f* and the valve body 5*d* are also joined to each other, it is possible to displace the valve body 5*d* being completely interlocked with the displacement of the diaphragm 5*c*. Accordingly, the expansion valve 5 can respond quickly.

In this connection, in the first embodiment, as the valve body 5*d* is pressed down by the spring 5*q*, when a deformation speed of the spring 5*q* is lower than a displacement speed of the diaphragm 5*c*, there is a possibility that the valve body 5*d* can not be completely interlocked with the displacement of the diaphragm 5*c*.

As the second diaphragm case 5*s* is formed being integrated with the housing 5*j* into one body, the dimensional accuracy among the diaphragm 5*c*, valve body 5*d* and valve seat 5*h* can be enhanced.

In the above embodiment, the present invention is applied to the air-conditioner for vehicle use. However, it should be noted that the present invention is not limited to the above specific embodiment.

The structure of the internal heat exchanger 7 is not limited to the specific structure shown in the above embodiment.

While the invention has been described by reference to specific embodiments chosen for purposes of illustration, it should be apparent that numerous modifications could be made thereto, by those skilled in the art, without departing from the basic concept and scope of the invention.

What is claimed is:

1. A vapor-compression-type refrigerating machine for moving heat from a portion on the low temperature side to a portion on the high temperature side, comprising:

a compressor for sucking and compressing refrigerant;

a radiator for radiating heat from the refrigerant of high pressure;

an expansion valve for decompressing and expanding the refrigerant cooled by the radiator;

an evaporator for evaporating the refrigerant decompressed by the expansion valve so that heat can be absorbed by the refrigerant; and an internal heat exchanger for exchanging heat between the refrigerant of high pressure before the decompression by the expansion valve and the refrigerant of low pressure to be sucked by the compressor, the expansion valve including:

a thin film-like diaphragm forming an airtightly closed space into which a predetermined mass of gas is enclosed;

a valve body for changing a degree of throttle opening being interlocked with a displacement of the diaphragm;

a spring for giving an elastic force to the valve body in a direction so that a volume of the airtightly closed space can be reduced, from an opposite side of the diaphragm to the side of the diaphragm on which the airtightly closed space is located; and a load giving portion for giving an initial load to the spring, wherein pressure in the airtightly closed space changes according to the temperature of the refrigerant flowing out from the evaporator, pressure of the refrigerant flowing out from the evaporator acts on an opposite side of the diaphragm to the side of the diaphragm on which the airtightly closed space is located, and the load giving portion can not be moved with respect to the housing.

2. A vapor-compression-type refrigerating machine according to claim 1, wherein the internal heat exchanger is a double tube composed of an inner cylindrical tube and outer cylindrical tube.

3. A vapor-compression-type refrigerating machine according to claim 1, wherein the expansion valve is accommodated in a piping means composing a refrigerant passage in which the refrigerant at low pressure flows.

4. A vapor-compression-type refrigerating machine according to claim 3, wherein the expansion valve is fixed so that it can be elastically displaced in the piping means.

5. A vapor-compression-type refrigerating machine according to claim 1, wherein the internal heat exchanger and the expansion valve are integrated with each other into one body.

6. A vapor-compression-type refrigerating machine for moving heat from a portion on the low temperature side to a portion on the high temperature side, comprising:

a compressor for sucking and compressing refrigerant;

a radiator for radiating heat from the refrigerant of high pressure;

an expansion valve for decompressing and expanding the refrigerant cooled by the radiator;

an evaporator for evaporating the refrigerant decompressed by the expansion valve so that heat can be absorbed by the refrigerant; and an internal heat exchanger for exchanging heat between the refrigerant of high pressure before the decompression by the expansion valve and the refrigerant of low pressure to be sucked by the compressor, the expansion valve including:

a thin film-like diaphragm forming an airtightly closed space into which a predetermined mass of gas is enclosed; and a valve body for changing a degree of throttle opening being interlocked with a displacement of the diaphragm, wherein pressure in the airtightly closed space changes according to the temperature of the refrigerant flowing out from the evaporator, pressure of the refrigerant flowing out from the evaporator acts on an opposite side of the diaphragm to the side of the diaphragm on which the airtightly closed space is located, and the diaphragm is displaced only by a difference in pressure between the airtightly closed space and the refrigerant flowing out from the evaporator.

7. A vapor-compression-type refrigerating machine according to claim 6, wherein the connecting rod for connecting the diaphragm with the valve body is joined to the diaphragm and, further;

the connecting rod is joined to the valve body.

8. A vapor-compression-type refrigerating machine according to claim 6, wherein a diaphragm case for supporting the diaphragm from the opposite side to the side, on which the airtightly closed space is located, is integrated with the housing, in which the valve seat is formed, by means of integral forming or joining.

9. A vapor-compression-type refrigerating machine according to claim 6, wherein the internal heat exchanger is a double tube composed of an inner cylindrical tube and outer cylindrical tube.

10. A vapor-compression-type refrigerating machine according to claim 6, wherein the expansion valve is accommodated in a piping means composing a refrigerant passage in which the refrigerant at low pressure flows.

11. A vapor-compression-type refrigerating machine according to claim 10, wherein the expansion valve is fixed so that it can be elastically displaced in the piping means.

12. A vapor-compression-type refrigerating machine according to claim 6, wherein the internal heat exchanger and the expansion valve are integrated, with each other, into one body.

* * * * *